United States Patent [19]

Menges

[11] Patent Number: 4,699,040

[45] Date of Patent: Oct. 13, 1987

[54] ARRANGEMENT FOR STOPPING THE MOVING PARTS OF A MACHINE CANNON HAVING AN EXTERNAL DRIVE

[75] Inventor: Horst Menges, Ratingen, Fed. Rep. of Germany

[73] Assignee: Rheinmetall GmbH, Duesseldorf, Fed. Rep. of Germany

[21] Appl. No.: 849,051

[22] Filed: Apr. 7, 1986

Related U.S. Application Data

[63] Continuation-in-part of Ser. No. 604,907, Apr. 27, 1984.

[30] Foreign Application Priority Data

May 3, 1983 [DE] Fed. Rep. of Germany ..... 3316072

[51] Int. Cl.[4] ..... F41D 7/00; F41D 7/02

[52] U.S. Cl. ..... 89/11; 89/9; 89/12

[58] Field of Search ..... 89/9, 11, 12

[56] References Cited

U.S. PATENT DOCUMENTS 4,193,335 3/1980 Tassie ..... 89/7
4,508,006 4/1985 Post et al. ..... 89/24
4,550,641 11/1985 Bruderer et al. ..... 89/12

FOREIGN PATENT DOCUMENTS 0063680 11/1982 Fed. Rep. of Germany ..... 89/24

*Primary Examiner*—John F. Terapane
*Assistant Examiner*—Eric Jorgensen

[57] ABSTRACT

An arrangement for rapidly stopping the movable parts of machine cannons with independent external drives wherein a rotating element, which rotates in dependence to a rotating control drum drivingly connected to the breech block, is stopped at misfiring or delayed firing within the breech block locking period of the firing cycle by a locking element which is actuated by propellant charge gas pressure. The arrangement of the invention prevents a shock-like braking and transfer of the kinetic energy of the movable parts of the machine cannon and provides for an automatic release of the blocking element.

The arrangement includes a rotating rod spring coaxially mounted within the control drum by means of which the kinetic energy of the rotating masses of the breech drive are elastically braked. Such energy transfer can even be effected with a delayed ignition because by means of positive interruption of the propellant charge gases traversing an annular chamber the release of the blocking element is prevented and it is not lifted off a cam disc. This blocking element can, however, be separately lifted of the cam disc by means of a release lever.

8 Claims, 4 Drawing Figures

ARRANGEMENT FOR STOPPING THE MOVING PARTS OF A MACHINE CANNON HAVING AN EXTERNAL DRIVE

CROSS-REFERENCE TO RELATED APPLICATION

This application is a continuation-in-part of our copending application Ser. No. 604,907, filed Apr. 27, 1984.

BACKGROUND OF THE INVENTION

Arrangements for rapidly stopping the movable parts of machine cannons with independent external drives are known and described in U.S. Pat. No. 4,508,006, filed on Apr. 26, 1982. In this known arrangement when it is necessary to rapidly stop the movable parts during a prescribed period all those massive rotating elements which form the breech drive and breech control mechanism, in particular the control drums, are suddenly stopped, whereby disadvantageously strong kinetic forces must be absorbed, which may damage the blocking pistons, the stop members and the drives. In such an arrangement no means are provided to automatically retract the blocking piston from a blocking position in which it contacts a stop surface. It is furthermore possible in such known arrangements, that the blocking piston, even prior to reaching its final blocking position, is gas pressure loaded and thereby only inadequately assumes the blocking position.

SUMMARY OF THE INVENTION

It is a general object of this invention to provide an arrangement of the afore-described type in which, during a misfiring, the impactlike transfer of the to be braked kinetic energy of the rotating mass of the breech drive onto the locking means is prevented, and in addition a kinetic energy reduction makes possible an increasing and decreasing kinetic energy transfer of the moving mass of the control drum. This energy transfer in the blocked position is effected in a flaw-free manner with each mis- or delayed firing. The weapon can thereafter be placed in a firing-ready position and the assumed blocking position is, after a waiting period, automatically released.

Thus the invention makes it possible that, when misfiring occurs or also when an extremely delayed ignition occurs, the kinetic energy of the rotating mass of the breech drive and breech control mechanism is rotationally elastically stopped without causing any malfunctioning. The machine cannon can be placed in a ready to fire position by means of the separate releasing means for the blocked position of the breech drive after a predetermined waiting period has elapsed. For the purpose of using the inner space of the control drum in a space saving manner, it becomes particularly advantageous to arrange a rotating rod spring within the control cylinder, whereby on one side of the control drum the rotating masses of the breech drive are elastically stopped and on the other side the rotating rod spring is directly placed in engagement with the control means of the blocking elements of the breech control mechanism while avoiding the trailing impact effects of the rotating masses.

BRIEF DESCRIPTION OF THE DRAWINGS

For an understanding of the principles of the invention, reference is made to the following description of the typical embodiments thereof as illustrated in the accompanying drawings.

In the Drawings.

DETAILED DESCRIPTION

Figure 1:
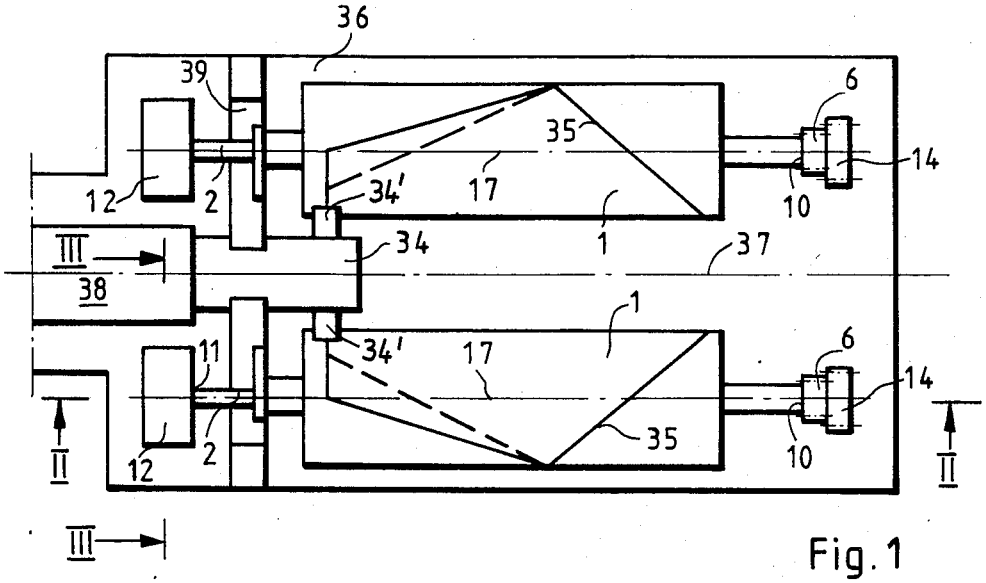
FIG. 1 is a plan view of a linearly moving breech mechanism which coacts with two control cylinders that provide a rapid-stop-means.

FIG. 1 illustrates a breech drive 6 for a movable breech block 34 that is coupled to and symmetrically arranged between the two rotatably mounted control drums 1. The breech block 34 is reciprocally moved via its bilateral projections 34' which engage in mating grooves disposed on the control drums 1. The control drums 1 are rotatably mounted within a weapon housing 36 so as to be positively connected to a rotating gear drive 14. One end 10 of a rotating rod spring 2 (made of spring steel) is formblockingly connected with the gear drive 14, which rotating rod spring 2 is rotatably mounted about the middle axis 17 disposed within the control drum 1. The other end 11 of the rotating rod spring 2 is provided with a stop-disc 12 forming part of a stopping arrangement which will be described in greater detail in conjunction with FIGS. 2 and 3. The breech block 34 of the gun barrel 38 is positioned, in dependence with the rotational movement of the control drums 1, in a locked position by means of sliders 39, which sliders do not form part of this invention.

The rod spring 2 is a torsion rod spring which in dependence to its length/diameter/ratio can be rotated over a considerable angular range. Such torsion rod springs are well known and are for example described in the "Engineering Fundamentals" by Opid W. Eshbach on page 548–549 (see enclosed photocopy of these pages). Such torsion rod spring is longer than the axial length of the control drum 1 and extends from the stop-disc 12 to the gear drive 14. By being advantageously mounted within the control drum 1, its length-/diameter/ratio is about 20:1, whereby a relatively large torsion angle $\alpha$ of 20 degrees is available when the rod 2 acts as a spring brake. Such an angular range cannot be attained by relatively short rods having a length/diameter/ratio of, for example 3:1. The mounting of such a rod spring within the control drum effects a large space saving without which a torsion rod spring 2 of the length contemplated herein could not be used in the stopping arrangement of this invention.

Figure 2:
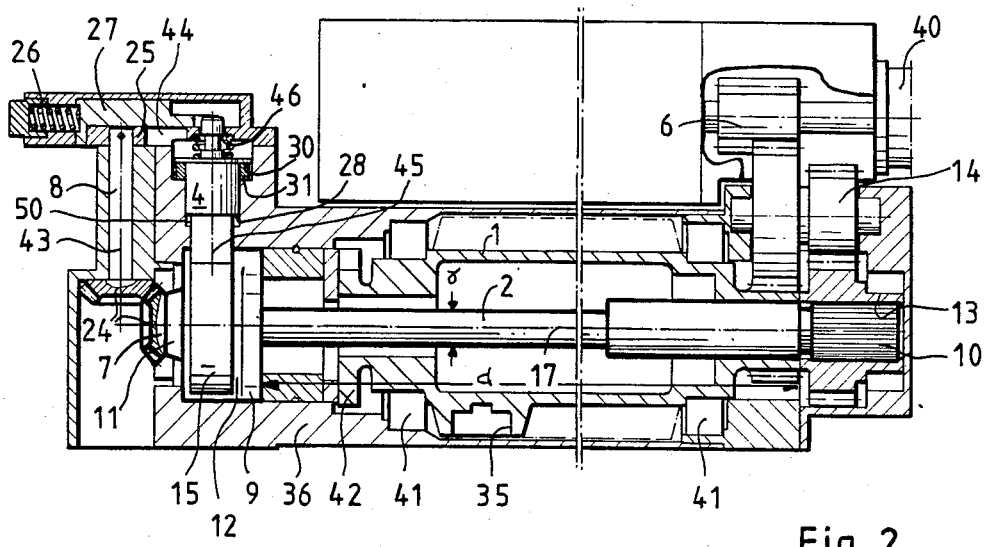
FIG. 2 is a cross-sectional view along the plane II—II of FIG. 1 which illustrates the arrangement of the rotating rod spring within the control cylinder.

As can be noted from FIG. 2, the control drums 1 are driven by a breech block drive 6, meshingly connected to the gear drive 14, which breech block drive 6 may be a motor 40 which may be a hydraulic motor or an electro motor. The gear drive 14 meshes simultaneously with the control drum 1 and the rotating rod spring 2 in such a way that a gear ratio i of the number of revolutions of the control drum 1 to the number of revolutions of the rotating rod spring 2 is at least equal to ($i=1$).

The gear ratio i is determined by the course of the groove 35 (FIG. 1), whereby one has to take into consideration that within a firing cycle the breech block 34 (FIG. 1) must, for purposes of breech locking, move in the direction of the gun barrel 38 (FIG. 1) and for unblocking must be retracted again. Each revolution of the rotating rod spring 2 corresponds to one blocking and unblockimng cycle of the breech block 34 (FIG. 1). The gear drive 14 meshingly engages the end 10 of the rod spring 2 via a gear wheel 13 mounted thereon. The rotating rod spring 2 is arranged centrally on the middle axis 17 within the control drum, whereby the end 10 is mounted within the control drum 1 and the end 11 is mounted exteriorly of the control drum 1 and is supported by means of the control disc 12 in the weapon housing 36. The control drum 1 is secured in the bearings 41 which are mounted within the weapon housing 36. The profile of the groove 35 can be seen at the exterior periphery of the control drum 1 (FIG. 2). Each control drum 1 is integral with a control body 42 which serves for locking the breech block 34 (FIG. 1), which control body 42 is not been illustrated in detail. At the end 11 of the rotating rod spring 2 there are coaxially and formlockingly mounted on the shaft 2 a conical gear wheel 7 (shown in heavy lines in FIG. 2) forming the transfer means and the stop-disc 12. The stop-disc 12 and conical gear wheel 7 are preferably integral with respect to each other. Rotatable control means 8 are mounted normally with respect to the middle axis 17 which means are rotatable about the axis 43. These control means 8 include a further toothed conical gear wheel which meshes with the conical gear wheel 7 of the transfer means to form a conical gear drive 24. Both conical wheels have the same number of teeth, so that the control means 8 rotate with the same number of revolutions at which the rotatable spring 2 is driven. At the other end of the control means (shaft) 8 there is mounted an eccentric disc 25 which is rotatable in a recess 44 of the locking disc 27. The locking disc 27 is slidably displaced counter to the force of the return spring 26 in dependence with the rotational movement of the rotatable rod spring 2, from which displaced position it can, during the further rotation of the unblocking disc 25 be returned by the spring force.

A blocking element 4 bears against the cam surface 15 of the stop-disc 12 which locking element 4 is slidably mounted in the housing 36. This locking element 4 is slidably displaceable along its axis 45 and has an annular surface 28 for gas pressure loading, an arresting surface 46 and a lifting surface 30. The functions of the locking element 4 in conjunction with the stop-disc 12 and the afore-mentioned surfaces are further explained in conjunction with FIG. 3. The stop-disc 12, which is formlockingly connected with the rotational rod spring 2 via a serrated surface 33, has a stop-surface 3 which merges with a special cam surface having a maximum exterior radius 22. The stop-surface 3 extends normally outwardly from the cam surface 15 on the exterior periphery of the stop-disc 12. There is provided parallel and contiguous to the cam surface 15, a second cam surface 9, which precedes in the rotational direction 16 the cam surface 15 and which is machined into the stop-disc 12. The stroke 21 of the control cam surface 9 is determined by the difference of the radii 22 and 20. In a stroke region 18 of the control cam 9 a gas locking bolt 5 bears against the control cam surface 9 via the return spring force of a spring 48, which stroke region 18 is in a transfer region from the minimum radius 20 cam surface into the outer radius 22 cam surface, which stroke is effected in the direction of the axis 47 of the rod 5 in a bore disposed in the weapon housing 36.

A ring channel 29 for blocking or releasing an opening 23 is disposed in the gas blocking bolt 5, by means of which, when a shot has been fired, the propellant gas can be transferred via further channel 49 into the annular chamber 50 for gas pressure loading the annular surface 28 of the blocking element 4. The blocking element 4 is disposed with its surfaces 51, 52, bearing against the stop surfaces 3 of the disc 12 in a locked position with respect to the stop-disc 12. The other end of the locking element 4 which faces away from the stop-disc 12 is provided with an arresting surface 46 at which surface the blocking element 4 is held for releasing the disc 12 and permitting the further rotation of the stop-surface 3 where the blocking element 4 was held. The transfer of blocking element 4 is effected by a locking slider 27 for a short period of time. The blocking element 4 is, independent from the propellant gas pressure, released against the return spring force of the spring 32, from its blocking position at which it bears against the stop surface 3 by means of a swingable unlocking lever 31. The unlocking lever 31 lifts the blocking element 4 by engaging it at the lifting surface 30. A separate unlocking can also be effected by means of a hydraulic cylinder 53 or a non-illustrated magnet, whereby the unlocking lever 31 which is pivotally mounted on the pivot shaft 54 is returned by return spring 55 into a position corresponding to the starting position or the blocking position of the blocking element 4.

Figure 3:
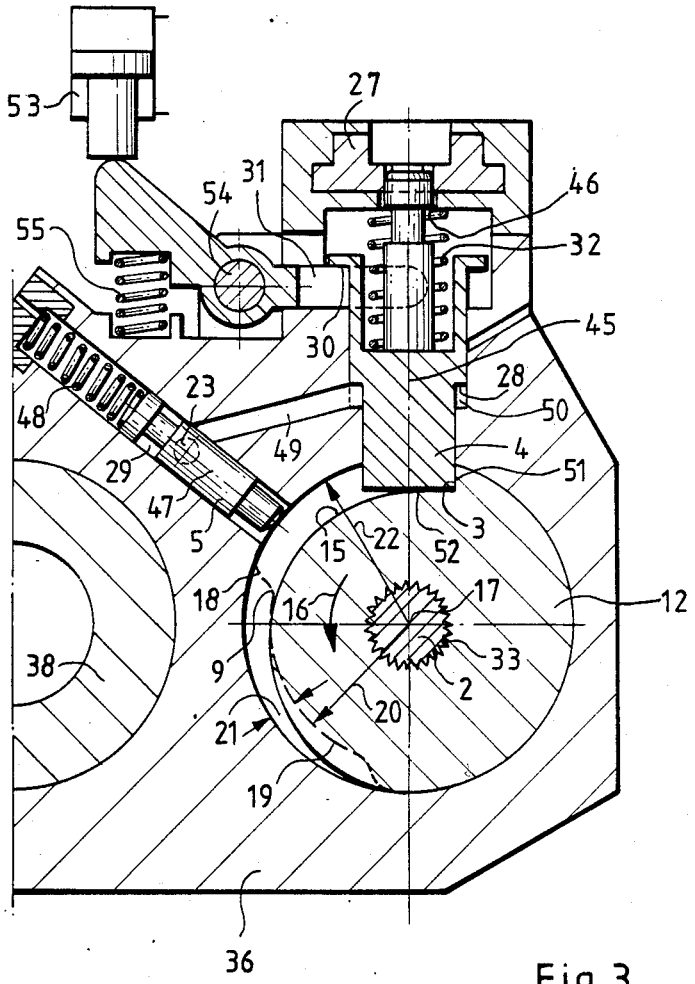
FIG. 3 is a partial cross-sectional view along the plan III—III in FIG. 1 which illustrates the rapid-stop-mechanism shown coupled to a rotating rod spring prior to firing of a chambered round and in a blocked position.
Figure 4:
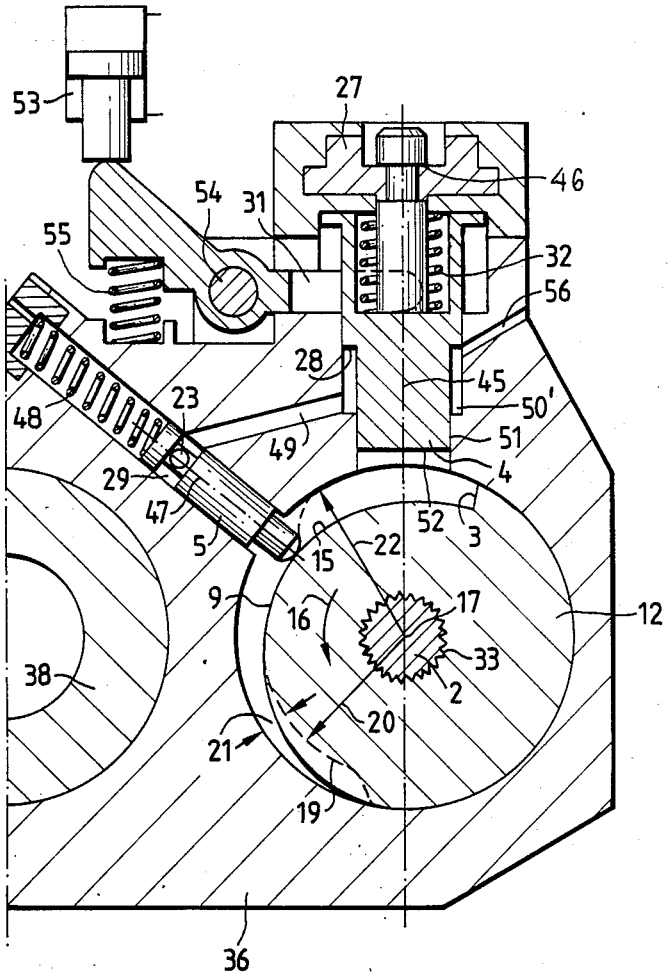
FIG. 4 is a partial cross-sectional view similar to FIG. 3 which illustrates the rapid-stop-mechanism in an unblocked position immediately after firing.

Whereas FIG. 4 illustrates the stop-disc 12 in a blocked position (when the chambered round has not yet been fired) as can be noted in FIG. 3 the opening 23 for the propellant charge gases is blocked by the gas blocking bolt 5 so that no gas pressure can built up in the annular chamber 50 which is in communication with the gas opening 23 via the channel 49 for purposes of lifting the locking element 4. On the other hand FIG. 4 illustrates the position of the stop-disc 12 immediately after a shot has been fired. This operation will be described hereinafter under the heading "Manner of Operation". In view of the fact that the gas blocking rod 5 is disposed, when a firing occurs, on the cam surface 9, and when in this position the opening 23 is unblocked, so that the propellant charge gas is capable to flow via the channel 49 into the annular chamber 50 and to built up for a short time a high pressure in dependence with the inflowing propellant charge gases and is venting via channel 56, so that the annular surface 28 of the blocking element 4 lifts off the stop surface 3 to release the stop disc 12. The blocking element 4 is held in the lifted up position by the locking slider 27 until the blocking element 4 has passed the stop surface 3.

When a shot has been fired, the rod 5 is disposed at the end of the control cam surface 9. At further rotation of the stop disc 12 in the rotational direction of the arrow 16, the control cam surface 9, whose diameter increases up to the outer radius 22, causes the gas flow locking bolt 5 to be lifted up again thereby blocking the opening 23 and preventing a gas feed into the annular chamber 50.

While the blocking element 4 is held by the locking slider 27, the gas pressure within the channel 49 and in the enlarged annular chamber 50' can be vented by means of a venting passages 56 which passage is disposed at the end of the stroke of the locking element 4.

After unlocking the blocking element 4 via the locking slider 27 this blocking element 4, via the return force of the coil spring 32, is slid back into the starting position on the periphery of the stop disc 12. The compression of the air within the channel 49 and the annular chamber 50, during the return stroke of the locking element is negligibly small, because the channel 49 can for example in a known manner, have a length of 500 mm thereby providing a relatively large compression volume.

MANNER OF OPERATION

By means of a drive motor 40 there are, at the beginning of a firing cycle, placed in rotation the control drums 1 and the rotating rod springs 2 via the gear drive 14. The breech block 34 is moved by means of the control drums 1 in the direction of the gun barrel 38 for introducing therein an ammunition unit and for assuming the locking position. The stop-disc 12 rotates in the direction of the arrow 16 about the middle axis 17, whereby the blocking element 4 assumes the releasing position corresponding to the peripheral cam surface having the radius 22 at which position it bears against this peripheral cam surface. Now the individual functional steps forming part of a firing cycle take place and these steps have no particular significance with respect to the subject matter of this invention. In the locking position of the breech block 34 the control cam 9 of the control disc 12 reaches with its region 19 the gas blocking bolt 5, which forcibly bears against the control cam surface 9 in this region and thereby unblocks the opening 23 via the ring channel 29. In this position a shot is fired. A partial volume of the propellant gases which is branched off from the gun barrel 38 arrives in the annular chamber 50 for the ring surface 28 and presses the blocking element 4 along its axis 45 against the force of the spring 32 away from its position at which it bears against the cam surface 15.

The unlocking disc 25 now releases the locking slider 27 so that it can assume the holding position for the blocking element 4. The locking slider 27 holds thereby the blocking element 4 at its arresting surface 46 for such a period of time in its released position, until the stop-surfaces 3 have passed the blocking element 4 in an unhindered manner. The unlocking disc 25 unlocks thereafter via the locking slider 27 the neck of the blocking element 4 so that by virtue of the return spring force of the spring 32 the blocking element 4 assumes the starting position at which it bears against the peripheral surface of the stop-disc 12. With a flaw-free operation this cycle repeats itself until it is interrupted by a firing mechanism that does not form part of this invention.

In the event of ignition failure and with an extremely delayed ignition no shot has been fired at the time of the gas locking bolt 5 passes along the cam region 19 of the control cam 9. Thus no propellant gas volume pressure results which can lift off the blocking element 4 from its control cam engagement with the cam 15. Still, before the stop-surface 3 comes into contact with the blocking element 4, there is closed the gas opening 23 by means of the gas locking bolt 5 which contacts the cam surface along a stroke region 18 which precedes in the rotational direction 16 the stop surface 3. Thereby there is prevented that the blocking element 4 is lifted off within the blocking time period and inadequately contacts the stop surface 3 to bear thereagainst. During the further rotation of the stop-disc 12 the stop surface 3 comes into contact with the blocking element 4 which glides along the cam surface 15.

There is now rotationally braked the breech drive 6 including the control drums 1 and the gear drives 14. The kinetic energy of their rotating masses are now elastically braked by means of the rotational absorption capacity of the rotational rod spring 2 and such braking is absorbed by this rotational rod spring 2. After a waiting period the assumed blocking position of the blocking element 4 at the stop surface 3 can, by actuating the unlocking bolt 31, be lifted, so that for purposes of removing the non-ignited ammunition the breech block 34 can be retracted and unlocked. For carrying out a new loading process no rotational movement in the direction 16 of the stop-disc 12 is necessary, but the breech drive 6 can continue to move, after lifting of the blocking position by the blocking element 4, in the rotational direction 16 of the stop-disc 12. By virtue of the fact that the blocking element 4 can assume the release position via the unlocking lever 31 it is possible in a simple manner to carry out also a test operation of the breech mechanism.

Although a limited number of embodiments of the invention have been illustrated in the accompanying drawings and described in the foregoing specification, it is to be especially understood that various changes, such as in the relative dimensions of the parts, materials used, and the like, as well as the suggested manner of use of the apparatus of the invention, may be made therein without departing from the spirit and scope of the invention, as will now be apparent to those skilled in the art.

I claim:

1. An improved arrangement for rapidly stopping at least a portion of the movable parts of a machine cannon with independent external drive, said movable parts include at least one control drum for driving the breech block of the machine cannon which drum is rotatably mounted in said arrangement, said control drum having the endless groove disposed on its outer periphery, a cam disc operatively mounted in said arrangement so as to rotate in dependence to said control drum, a blocking element having propellant charge gas pressure actuated control means operatively connected thereto which maintain said blocking element in a release position relative to said cam disc during the breech block locking time; however, when a misfiring or delayed firing occurs said blocking element blockingly contacting said cam disc, the improvement comprising:

(a) a rotating rod spring form-lockingly and coaxially connected adjacent to one of its ends to said cam disc;

(b) said rotating rod spring being coaxially and form-lockingly connected to said control drum adjacent to the other one of its ends, a gas pressure-actuated locking bolt is slidably mounted in said arrangement and bears against the periphery of said cam disc, and control means having rotatable transfer means operatively connecting said cam disc via said transfer means to said blocking element;

(c) when said blocking element is in a blocking position the kinetic energy of the mass of the movable parts forming the breech block drive is elastically braked via said rotating rod spring;

(d) the blocking position of said blocking element is assumed even with a delayed ignition by interrupting the propellant gas feed to said blocking element; and (e) wherein said rotating rod spring is coaxially disposed within at least one control drum.

2. The improvement in an arrangement for rapidly stopping at least a portion of the movable parts of a machine cannon as set forth in claim 1, including the following additional features:

(a) at the other one of its ends said rod spring having a toothed ring portion by means of which said rod spring is drivingly meshingly connected to a first gear drive;

(b) the number of revolutions of said control drum relative to the number of revolutions of the rod spring forms a gear ratio $i=1$;

(c) each revolution of said rod spring corresponds to a blocking and unblocking cycle of the breech block being driven via said endless groove on said at least one control drum.

3. The improvement in an arrangement for rapidly stopping at least a portion of the movable parts of a machine cannon as set forth in claim 2, including the following additional features:

(a) said cam disc having a first cam surface extending parallel to the rotational direction of the cam disc for coaction with said slidable locking bolt and a second spirally shaped cam surface having an end stop face parallel to said first cam surface for coaction with said blocking element;

(b) said first cam surface having a first portion which precedes in the rotational direction of the cam disc the stop face on said second cam surface, which first portion is shaped in such a way that said locking bolt bearing thereagainst closes a passage for transferring propellant charge gases for a predetermined period of time of the firing cycle, which occurs before said blocking element makes contact with said stop face; and (c) said first cam surface including a second portion which precedes in the rotational direction said first portion and has a smaller diameter than the maximum diameter of said first portion, the difference between the maximum diameter of said first portion and the smaller diameter of said second portion representing the stroke of said locking bolt when sliding from said first portion to said second portion along said first cam surface, whereby when said locking bolt slides over said second portion of said cam surface said passage for transferring propellant charge gases is opened.

4. The improvement in an arrangement for rapidly stopping at least a portion of the movable parts of a machine cannon as set forth in claim 3, wherein said locking bolt is slidably mounted in a bore of said arrangement, said passage for transferring propellant charge gases being in communication with said bore, said locking bolt being cylindrically shaped and having an annular groove for opening and closing said passage.

5. The improvement in an arrangement for rapidly stopping at least a portion of the movable parts of a machine cannon as set forth in claim 4, including the following additional features:

(a) wherein said control means and said cam disc are integrally and form-lockingly connected with said one end of said rod spring;

(b) said form-locking connection being formed by intermeshing serrated peripheral surfaces on a bore of said cam disc and the portion of said rod spring extending therethrough.

6. The improvement in an arrangement for rapidly stopping at least a portion of the movable parts of a machine cannon as set forth in claim 5, including the following additional features:

(a) said control means and transfer means having respectively conical gear wheels which meshingly engage each other;

(b) said control means being coaxially mounted on an extension of said rod spring so as to rotate jointly therewith and said transfer means being operatively connected to an unlocking disc;

(c) a blocking slider being slidably mounted in said arrangement and first means biasing said blocking slider for blocking engagement with said blocking element against the action of said unlocking disc.

7. The improvement in an arrangement for rapidly stopping at least a portion of the movable parts of a machine cannon as set forth in claim 7, including second means biasing said blocking element into the blocking position against said end stop face of said second spirally shaped cam surface, said blocking element is movable into a release position relative to said cam disc against the action of said second biasing means independent from the propellant charge gas pressure.

8. The improvement in an arrangement for rapidly stopping at least a portion of the movable parts of a machine cannon as set forth in claim 7, including the following additional features:

(a) wherein said blocking element includes an annular propellant charge gas pressure receiving surface and a lifting surface;

(b) and a lever pivotally mounted in said arrangement for separately lifting said blocking element via contact with said lifting surface against the action of said second biasing means.

* * * * *